US008952613B2

(12) United States Patent
Anderson et al.

(10) Patent No.: US 8,952,613 B2
(45) Date of Patent: Feb. 10, 2015

(54) LED ROOM LIGHT

(76) Inventors: Leroy E. Anderson, Boise, ID (US); David F. Shaw, Boise, ID (US)

( * ) Notice: Subject to any disclaimer, the term of this patent is extended or adjusted under 35 U.S.C. 154(b) by 59 days.

(21) Appl. No.: 12/778,839

(22) Filed: May 12, 2010

(65) Prior Publication Data

US 2010/0289407 A1 Nov. 18, 2010

Related U.S. Application Data

(60) Provisional application No. 61/177,312, filed on May 12, 2010.

(51) Int. Cl.

| | |
|---|---|
| ***F21V 29/00*** | (2006.01) |
| ***F21V 3/02*** | (2006.01) |
| ***F21K 99/00*** | (2010.01) |
| ***F21V 3/00*** | (2006.01) |
| *F21Y 101/02* | (2006.01) |
| *F21Y 111/00* | (2006.01) |

(52) U.S. Cl.

CPC . *F21V 3/02* (2013.01); *F21K 9/135* (2013.01); *F21V 3/005* (2013.01); *F21V 29/2206* (2013.01); *F21Y 2101/02* (2013.01); *F21V 29/2293* (2013.01); *F21Y 2111/007* (2013.01)

USPC ..... 315/35; 315/112; 315/50; 362/231; 362/294

(58) Field of Classification Search

CPC ... F21V 29/004; F21V 3/005; F21V 29/2293; F21V 29/006; F21V 29/2262; F21V 29/246; F21V 29/2225; F21V 29/2231; F21V 3/00; F21V 23/002; F21V 29/405; F21V 23/008; F21V 23/023; F21V 29/2206

USPC ..... 315/35, 112, 50, 158; 362/231, 294

See application file for complete search history.

(56) References Cited

U.S. PATENT DOCUMENTS

| | | | | |
|---|---|---|---|---|
| 4,727,289 | A | 2/1988 | Uchida | |
| 5,463,280 | A | 10/1995 | Johnson | |
| 5,749,646 | A * | 5/1998 | Brittell | 362/231 |
| 6,719,446 | B2 * | 4/2004 | Cao | 362/547 |
| 6,948,829 | B2 | 9/2005 | Verdes et al. | |
| 7,144,135 | B2 * | 12/2006 | Martin et al. | 362/294 |
| 7,226,189 | B2 * | 6/2007 | Lee et al. | 362/294 |
| 7,344,279 | B2 * | 3/2008 | Mueller et al. | 362/294 |
| 7,347,586 | B2 | 3/2008 | Izardel | |
| 7,347,589 | B2 | 3/2008 | Ge | |
| 7,350,936 | B2 | 4/2008 | Ducharme et al. | |
| 7,396,142 | B2 | 7/2008 | Laizure, Jr. et al. | |
| 7,600,882 | B1 * | 10/2009 | Morejon et al. | 362/84 |
| 7,758,223 | B2 * | 7/2010 | Osawa et al. | 362/547 |
| 7,976,211 | B2 * | 7/2011 | Cao | 362/650 |
| 8,066,414 | B2 * | 11/2011 | Pabst et al. | 362/373 |
| 2006/0198147 | A1 * | 9/2006 | Ge | 362/294 |
| 2007/0296350 | A1 * | 12/2007 | Maxik et al. | 315/291 |
| 2008/0062703 | A1 * | 3/2008 | Cao | 362/311 |

(Continued)

*Primary Examiner* — Douglas W Owens
*Assistant Examiner* — Amy Yang
(74) *Attorney, Agent, or Firm* — Robert L. Shaver; Dykas & Shaver

(57) ABSTRACT

Disclosed is a light bulb which utilizes LEDs which replaces an incandescent light bulb in a fixture for incandescent light bulbs. The LED light bulb includes a multi-faceted head on which multiple LEDs are placed, with the multi-faceted head being in contact with heat dissipation structures. The heat dissipation structures include a heat transfer column which extends from the LEDs to the base of the bulb. A removable cover is enclosed which has openings for air circulation within the globe of the light bulb.

5 Claims, 4 Drawing Sheets

(56) References Cited

U.S. PATENT DOCUMENTS

2009/0273940 A1* 11/2009 Thurgood et al. ..... 362/373
2009/0284977 A1* 11/2009 Daffin ..... 362/310
2010/0096992 A1* 4/2010 Yamamoto et al. ..... 315/112

* cited by examiner

LED ROOM LIGHT

PRIORITY/CROSS-REFERENCE TO RELATED APPLICATIONS

This application claims the benefit of U.S. Provisional Application No. 61/177,312, filed May 12, 2009, the disclosure of which is incorporated by reference.

BACKGROUND

Light emitting diodes (LEDs) have been used in recent years in more and more lighting applications. Some have been used to light room lights, and even to operate in fixtures for conventional light bulbs. A problem with all LED lights is dissipating the heat from the LED itself. The heat from the LED is enough to easily destroy the LED itself unless it is conducted away from the LED so that the LED stays below the critical temperature of that particular model of LED. That critical temperature is typically above 200°. LED equipped light bulbs have dealt with the problem of dissipating in various ways. This can include making the output of the LEDs fairly low, having a large number of LEDs so that each one does not have to put out a lot of heat, and having various structures for dissipating heat. Improved ways of dissipating heat and making LEDs function to replace conventional incandescent light bulbs is therefore a desirable goal of a new product.

SUMMARY OF THE DISCLOSURE

The invention is a light bulb which is based on LED technology which utilizes at least one LED, and which has a base which is configured to fit in a standard socket for an incandescent bulb. An important design criterion for any LED application is removing the heat that is produced by an LED. The LED light bulb of the invention has several systems for removing heat from the LED, including conducting heat away from the LED, radiating heat into other structures and into the surrounding air, and providing a route for convection cooling of the LED with air circulation through the globe.

The light bulb of the invention has a bulb base which is made up of a conductive socket with a first electrode at the apex of the socket and a second electrode around the sides of the socket. The second electrode is formed into the shape of a threaded cylinder, with the entire cylinder being conductive to the second electrode. The threaded cylinder circumvolves the cylindrical bulb base. The upper edge of the second electrode forms the upper edge of the base. The shape of the bulb base is the same shape as is found in a typical incandescent light bulb and fits into the socket of incandescent light bulbs. An insulator sleeve 68 insulates the rest of the bulb components from electricity.

Adjacent to the bulb base is a generally cylindrical radiator section. The radiator section has at least one generally circular radiator ring with a radiator fin. The radiator fin is configured to expel heat from the bulb. Preferably, the radiator section has more than one radiator fin, with an air space or groove between the radiator fins. The radiator section is a heat sink, and may be machined, die cast, or stamped or made in any other conventional manner, with one or more radiating fins for providing additional surface area for dissipating heat to the atmosphere.

The bulb includes at least one LED which is positioned inside the bulb on a column, and is surrounded by a removable globe. The column can be several different heights, depending on the desired light spreading capabilities of the light bulb. The column on which the LED bulb is placed is made of a material such as silicone or epoxy, which is configured to be conductive of heat but non-conductive of electricity. The column on which the LED is mounted extends from above the radiator section and into the bulb base. The LED may also sit directly on a part of the radiator section, with the column being contiguous with the radiator section. Electrical connections from the first and second electrode go through the column and the radiator section and connect to the LED.

The bulb also includes a globe of glass, plastic, or other material which covers the LED and which attaches to a globe base. The globe base attaches to the radiator section. The globe serves to provide a grip for a user when screwing the bulb into an incandescent bulb socket. It also protects the LED bulb from contact with foreign objects. The interior of the bulb may be evacuated, but with current LED technologies, the interior of the bulb does not need to be evacuated, and in fact may have ventilation holes.

The column on which the LED bulb is placed can be formed with a metallic tube around the outside surrounding a core of thermally conductive but electrically nonconductive epoxy. The column can include a ridge, tabs, teeth, or a centrally sloped crimp ring, which provides increased physical connection between the metallic tube and the epoxy core. The conductive column can extend into a faceted base, and can fill the bulb base, which provides additional physical strength to the base of the bulb and additional mass and surface area for dissipation of heat. The LED of the invention can be covered by a plastic lens, with the plastic lens providing protection to the LED, as well as providing optical direction capabilities to the LED.

More than one LED can be utilized by the bulb. One type of an LED is a square LED which is subdivided into four separate LED sections. Other multi-LED units can be utilized, including units with four, nine, or other combinations of LED units. Additionally, LEDs may also be utilized with each mounted on a portion of the column which is slanted in a different direction, as in facets in a jewel. Thus, one LED would be pointed directly towards the top of the bulb, and other LEDs could be angled so that light is mostly directed in different directions. Thus, the bulb can be configured to be a spotlight, or to provide more light and to direct light in different directions.

The bulb can also include a printed electronic control circuit, which is configured to control the functions of the LED light. This can include controlling the output, controlling the flow of electricity to the LED light, and functioning as an engine, a converter, a transformer, and/or a capacitor. The function of an engine in this context includes all of the elements necessary to provide an even and steady flow of electricity to the LED, including a transformer, capacitor, voltage regulator, and converter.

The light bulb of the invention can also include one or more openings for air movement, to facilitate cooling for the LED light and its associated heat sink and radiator. The air openings can include one or more near the base, and one or more near the top of the globe.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
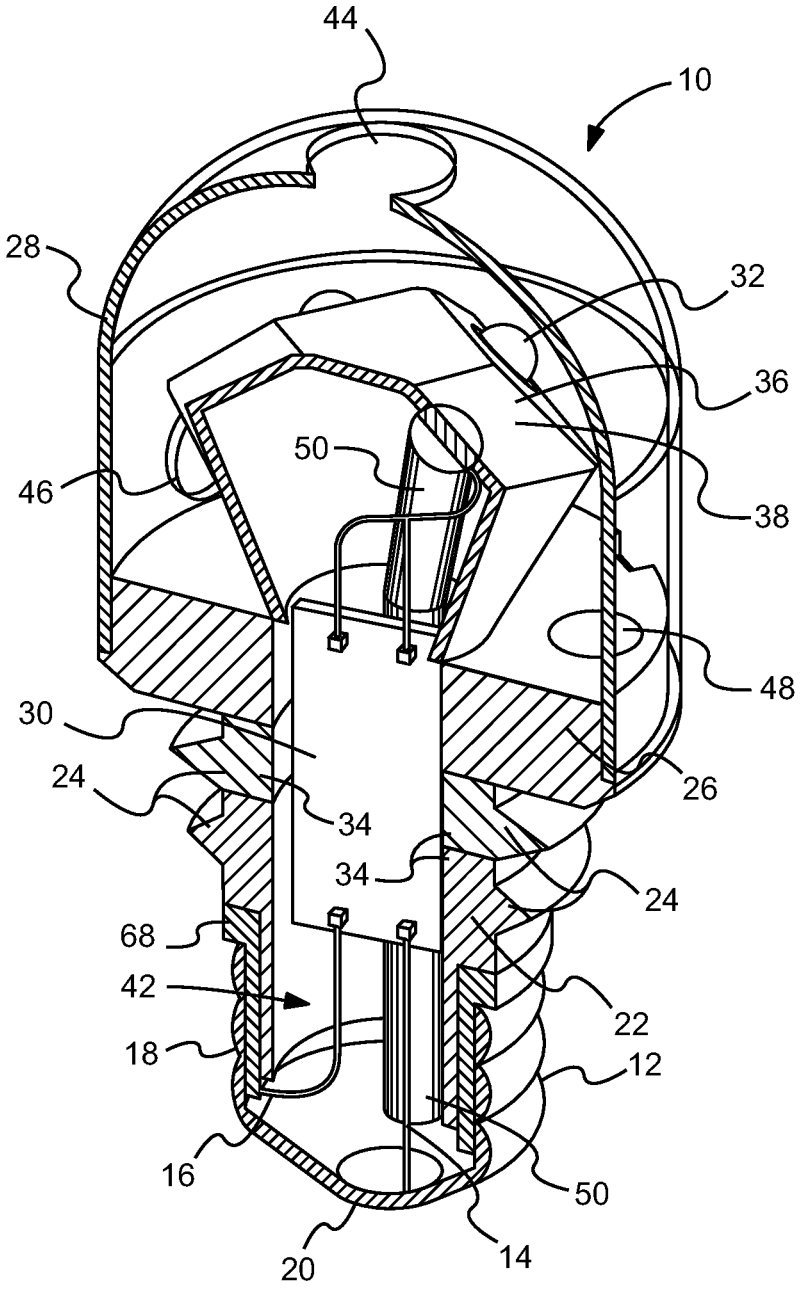
FIG. 1 is a perspective view of a cross section of the light bulb.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Several preferred embodiments of the LED light bulb of the invention are shown in FIGS. 1 through 5.

FIG. 1 shows the LED light bulb 10 of the invention. It includes a bulb base 12 to which is attached a first electrode 14 and a second electrode 16. The second electrode 16 is electrically connected to the sidewall 18 of the bulb base. The bulb base 12 fits into a standard electrical socket for a light bulb. The bulb base 12 of the current invention thus connects the LED light bulb both physically and electrically to the electrical socket of a standard light bulb socket. Shown in FIG. 1 is the apex 20 of the light bulb.

Adjacent to the bulb base 12 is a radiator section 22 which includes at least one radiator ring 34 with a radiator fin 24. The radiator section 22 may include an additional radiator ring 34 which has an additional radiator fin 24. The radiator rings would preferably be made of aluminum, or another heat conducting material. Attached adjacent to the radiator section is a globe base 26. The globe base 26 would also be made of aluminum or another heat conducting material with similar properties to aluminum. The bulb base 12, the radiator rings 34, and the globe base 26, all define an interior column 42, in one preferred embodiment. As shown in FIG. 1, the column is a hollow portion that extends through all of these pieces. The column is capped by a multi-faceted head 36. Inside the column 42 is positioned a control circuit board 30. Mounted on this control circuit board are the components that are typically required to power an LED light. These components can include a converter, a transformer, a capacitor, and a power selector. For instance, a selected LED light can be operated at different milliamps, and the power output in milliamps can be selected on the control board, or on a switch attached to the control board.

The multi-faceted head 36 is topped by a number of facets 38, with each facet being a planar structure with an LED light 32 mounted on the facet, and directed in a different direction from the other LED lights. The faceted head 36 may be made of a conductive material, such as copper, with the LED attached to it by something like a double sided tape. Such close contact serves to dissipate heat from the LED and keep the LED below the critical temperature of the LED. Other heat dissipating structures can be in close proximity to the LED, such as copper cones with the point toward the interior of the facet head, and the flat end adjacent to the LED.

The column 42 shown in FIG. 1 is depicted as being hollow, but in the manufacturing process it would be filled with a liquid material which solidifies into a solid. Thus, the column 42 would be completely filled by solid material, preferably a type of epoxy or silicone which is nonconductive of electricity but which is conductive of heat.

Also shown in FIG. 1 is a globe 28 which is removably attached to the globe base 26. The attachment of the globe to the globe base can be by a friction mount, threaded, twist lock or other conventional attachment means. Shown in FIG. 1 is a first air hole 44 which is defined in the top of the globe 28, and also depicted is a second hole 46 in a lower portion of the globe 28, and a ventilation hole 48 in the globe base 26. Shown in FIG. 1 is an optional heat transfer rod 50 which extends from the bulb base 12 to a position adjacent the LED light 32. The LED light bulb 10 can optionally include multiple heat transfer rods 50, which may be made of copper or aluminum, or another good conductor and would provide a more efficient heat transfer route for heat generated by the LED to be dispersed throughout the heat absorbing structures of the light bulb. The heat transfer rods 50 would be particularly useful if it is made of a material which transfers heat better than the epoxy filling the column. At present the elements copper and aluminum are quite a bit more conductive of heat than are commonly used potting materials. For this reason a direct connection between the LEDs and the heat transfer rods 50 or other heat transfer surfaces is desirable. This can include the faceted head being covered with copper or made of solid copper. Since copper is electrically conductive, the LED must be attached to a nonelectrically conductive surface like the LED insulator pad 70 shown in FIG. 3. Something like a double sided tape works for this application.

A suitable type of material to form the column 42 of the invention is a product called TCR, made by Electrolube. It is a thermal transfer material and provides excellent thermal conductivity and cures at room temperature without an oil residue. RTV stands for Room Temperature Vulcanizing, and are typically silicone based and contain a proprietary mix of mineral fillers which aid in heat conduction.

A type of LED which has proven successful is an LED that operates between 300 milliamps and 750 milliamps. A switch on the device can be used to adjust the intensity of light output for this reason. It is to be understood that this is merely one example of a suitable LED, and the invention is made to be useful with any number of LEDs, depending on the particular application that a particular bulb is designed for.

Figure 2:
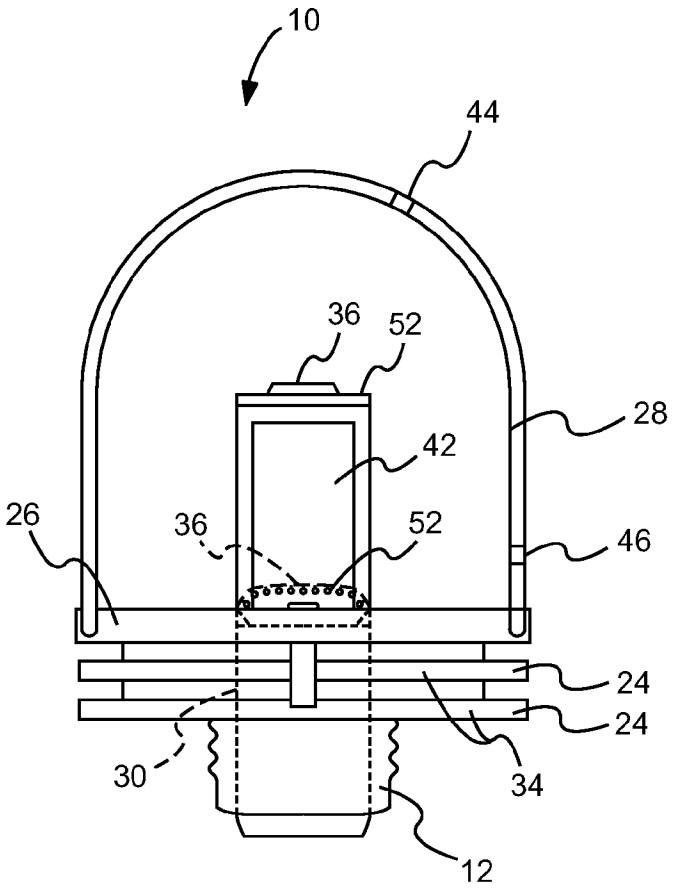
FIG. 2 is a cross sectional view of a different embodiment of the light bulb.

FIG. 2 shows a different embodiment of the invention. Shown in FIG. 2 is a bulb base 12 with radiator rings 34 and radiator fins 24. There is a globe base 26 and a globe 28. Shown in the globe is a first air hole 44 and a second air hole 46. The bulb of FIG. 2 includes a column 42 which would be formed of solidified epoxy. Inside the column 42 is a control circuit board 30. The column is topped by a multi-faceted head 36, which is shown at two possible heights. A different length of column will result in the multi-faceted head 36 being positioned at a different height. The different height of the LEDs on the multi-faceted head 36 effect the spread of the light from the LEDs. A higher column will result in light which is spread closer to a 360° pattern. Shown in FIG. 2 is a centrally sloped crimp ring 52. The LEDs of the light are attached to the crimp ring 52 and the crimp ring 52 is secured to the column when the epoxy of the column is in a liquid form.

Figure 3:
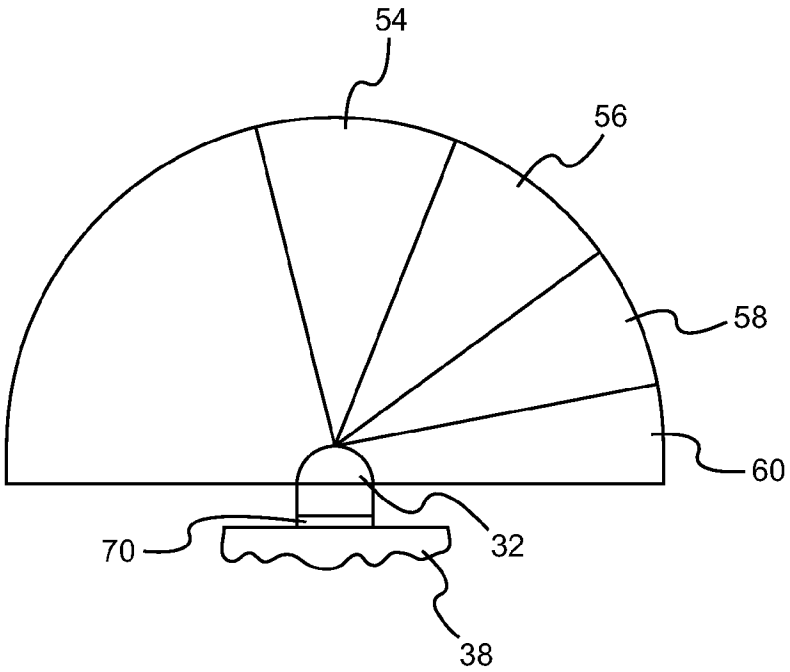
FIG. 3 is a representation of the light output from an LED.

FIG. 3 shows an important feature which is utilized in the construction of the light bulb of the invention. FIG. 3 shows an LED 32 with a display of the type of light which is emitted from the LED at different angles. In the center of the beam 54 the light is a very white light. At the inner region adjacent to the center of the beam is a side beam 56 which is a region of the beam which is still white but is less intense than the center of the beam 54. Adjacent to first side beam 56 is a second side beam 58, which is still perceived as being white, but could be called warm white, and is noticeably different than the first side beam and the center of beam 54 and 56. Finally, at the extreme range of the beam of light from the LED, there is a third side beam 60 whose light could be described as yellowish light. Producing a quantity of yellowish light improves the Color Rendering Index (CRI) of the bulb, which is a desirable feature and helps to meet the specifications required of LED light. A higher CRI means that the light produced is closer to the full visible spectrum of light. Bright white light that many LEDs produce has a lower CRI than is desired by many users.

These different light beams emanating from a single LED are combined in the invention to good advantage by having each LED directed in a different direction. This allows light from a single bulb to throw several beams of intense white light in different directions surrounding the bulb, to create a bulb which has excellent ability to light a room.

Figure 4:
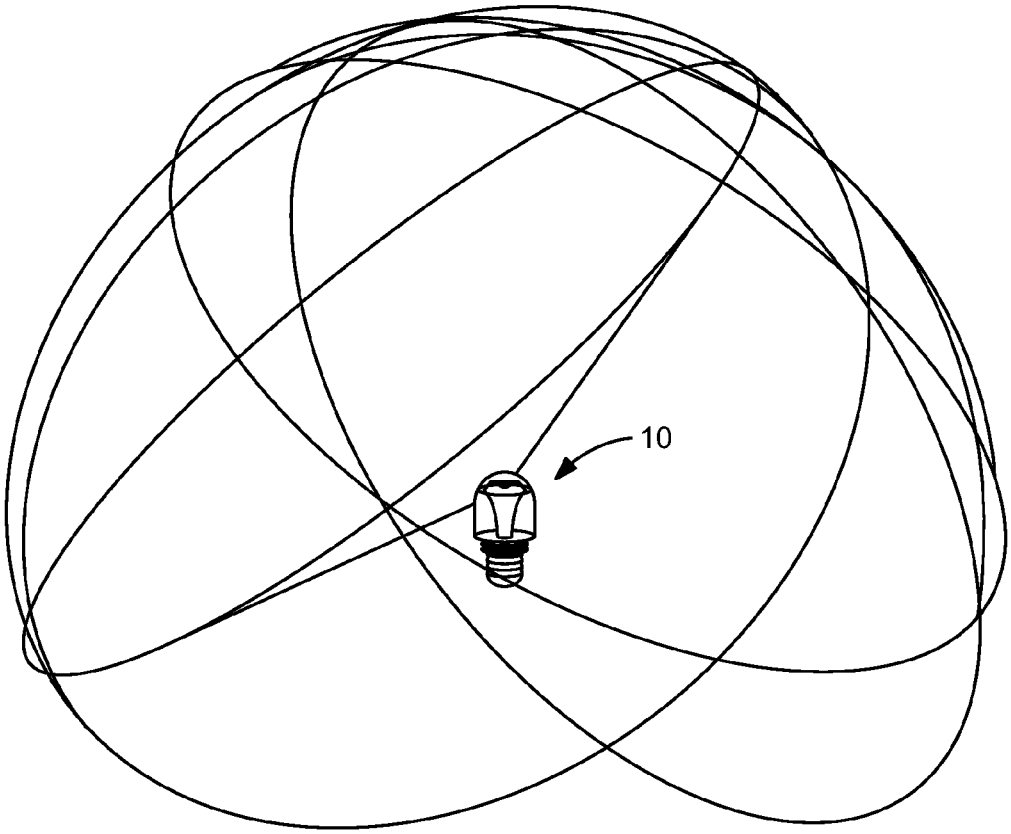
FIG. 4 is a three dimensional view of the light output from a bulb with four LEDs.

The effect of these different light beams of different intensities is shown in FIG. 4, where the LED light of the invention is shown along with the cones of light which are emitted by each LED, with the spread of light being spread sufficiently to effectively light an area.

FIG. 4 and FIG. 1 show a bulb of the invention with 4 LEDs. An LED can also be mounted on the very top of the column, directed away from the base, and more than four facets can be incorporated into the multi-faceted head 36, and the facets can be in more complex configurations to provide the effects by a particular situation.

Figure 5:
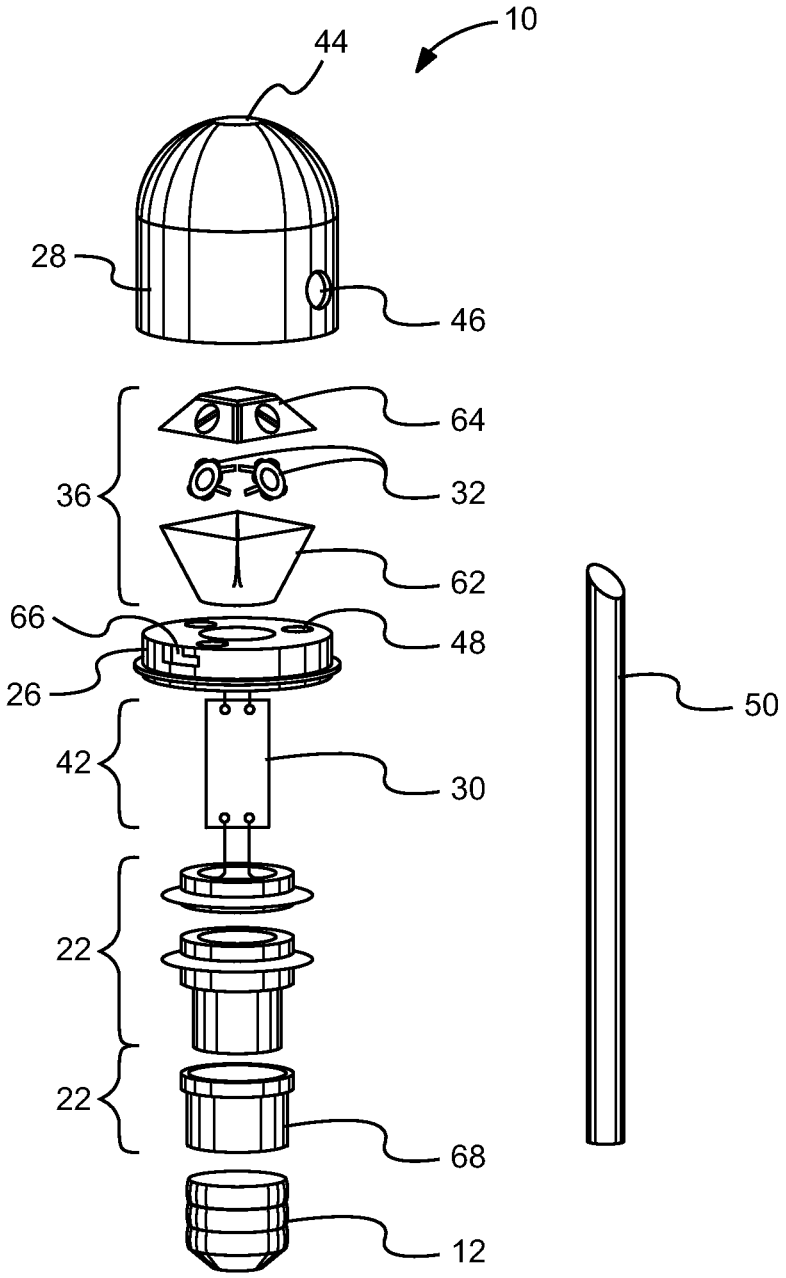
FIG. 5 is an exploded view of the LED light bulb.

FIG. 5 is an exploded view of a facet head base 62 and a facet head cap 64, which together form the multi-faceted head 36, and the globe 28. The facet head cap 64 may be copper for improved heat transfer, as may be the facet head base 62. Internal structures such as heat transfer rods 50 may be placed inside the column 42 to conduct heat away from the LEDs 32. Shown on the globe 28 is a first air hole 44 and a second air hole 46. Shown on the globe base 26 is a ventilation hole 48 and a twist lock 66 for securing the globe 28 to the globe base 26. Shown is an insulator 68 which insulates the radiating section 22 from electricity from the bulb base.

While certain exemplary embodiments are shown in Figures and in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. An LED light bulb for use with a socket for incandescent bulbs, comprising:

a bulb base, comprising a conductive socket with a first electrode at an apex of said socket, and a second electrode in electrical connection with a sidewall of said bulb base, with said electrodes configured to physically and electrically engage a standard light bulb socket configured for incandescent bulbs;

a generally cylindrical radiator section attached adjacent to said bulb base, said radiator section with at least one generally circular radiator fin circumvolving said bulb base, said radiator section for expelling heat from said bulb;

a generally planar globe base attached to said radiator section, said globe base configured for removable attachment of a globe, and said globe base defining a plurality of openings for ventilation adjacent a globe base edge, with said globe comprising generally cylindrical sidewalls and a spherical top, enclosing an air space around LEDs, with an opening near said globe top and a plurality of openings in glove sidewalls, for air circulation by passive convection through said air space above said LED and inside said globe, with said holes providing air convection paths based on the principle of by warm air rising, when said light bulb is in any spacial orientation, said globe serving to protect said LED from contact with foreign objects and being removable from said globe base;

a control circuit including electronics components for powering and regulating electricity to an LED light;

at least one LED positioned inside said globe on said globe base, with said LED electrically connected to said first and second electrode by electrical connections, and configured to emit light when energized, with said LED in thermal contact with said bulb base, said globe base, and said radiator section.

2. The LED based light bulb of claim 1 in which said radiator section further comprises a plurality of circumvolving radiator fins for expelling heat produced by said at least one LED.

3. The LED light bulb of claim 1 in which said radiator section is comprised of two of more adjacent circumvolving radiator rings with radiator fins.

4. An LED light bulb for use with a socket for incandescent bulbs, comprising:

a bulb base, comprising a conductive socket with a first electrode at an apex of said socket, and a second electrode in electrical connection with a sidewall of said bulb base, with said electrodes configured to physically and electrically engage a standard light bulb socket configured for incandescent bulbs;

a generally cylindrical radiator section attached adjacent to said bulb base, said radiator section with at least one generally circular circumvolving radiator fin, said radiator section for expelling heat from said bulb;

a generally planar globe base attached to said radiator section, said globe base configured for removable attachment of a globe, said globe serving to protect said LED from contact with foreign objects and being removable from said globe base, said globe comprising generally cylindrical sidewalls and a domed top, and enclosing an air space around one or more LEDs, and defining a plurality of vent openings in said globe base, at least one opening in a top of said globe, and a plurality of vent openings in said globe sidewalls, allowing passage of air through said globe base, and through vent openings in said globe top and said globe sidewalls, for heat transfer by air circulation, so that said bulb allows convective air cooling of said LEDs by movement of air in said air space inside said globe, with said bulb configured for passive convective cross current air flow through said air space in said globe no matter the orientation of said bulb, with said vent openings providing circulating paths when the bulb is in any particular special orientation;

a control circuit including electronics components for powering and regulating electricity to an LED light;

at least one LED positioned inside said globe on said globe base, with said LED electrically connected to said first and second electrode by electrical connections, and configured to emit light when energized, with said LED in thermal contact with said bulb base, said globe base, and said radiator section;

a heat conducting column extending from said bulb base, through said radiator section and said globe base, and extending above said globe base, said column terminating in a multi faceted head, with each facet configured for mounting one or more LEDs, with each facet at a different angle from other facets and made of a heat conducting material, and with LEDs on said facets directed in a different direction from other LEDs, for providing light in different directions for different zones of a room, said column comprised of heat conductive/ electricity non-conductive material, with said column having a base end and an LED end, said column in thermal contact with said LED light and encasing said control circuit, and with said LED mounted on said LED end of column in close proximity to a heat transfer structure with thermal contact with said bulb base, and further comprising one or more conductive rods, each rod with an LED end and a base end, and extending from a point adjacent to an LED through and encased in said column, for improved heat movement from said LED through said column.

5. The LED light bulb of claim 4 which further comprises 4 or more vent holes in sidewalls of said globe, and 4 or more vent holes in said globe base, providing multiple air convection routes for improved air circulation and turnover of air inside said globe, with said convection routes configured to providing ventilation with the bulb in any spacial orientation.

* * * * *